United States Patent [19]

Solomon

[11] 4,037,222

[45] July 19, 1977

[54] SUPERVISION OF TRANSDUCERS

[75] Inventor: Elias E. Solomon, Duxbury, Mass.

[73] Assignee: Gulf & Western Manufacturing Company (Systems), New York, N.Y.

[21] Appl. No.: 618,760

[22] Filed: Oct. 2, 1975

[51] Int. Cl.[2] ..... G08B 21/00

[52] U.S. Cl. ..... 340/261; 179/175.1 A; 340/224; 340/248 E; 340/409

[58] Field of Search ..... 340/261, 409, 411, 214, 340/248 E, 248 R, 253 B, 253 Q, 52 F, 63, 224, 416; 179/175.1 A

[56] References Cited

U.S. PATENT DOCUMENTS

| | | | |
|---|---|---|---|
| 1,958,153 | 5/1934 | Pearson et al. | 340/261 |
| 2,393,021 | 1/1946 | Cheek | 340/224 |
| 2,525,697 | 10/1950 | Lurie | 340/409 |
| 3,656,158 | 4/1972 | Goodwater | 340/409 |
| 3,707,708 | 12/1972 | Dan | 340/416 |

FOREIGN PATENT DOCUMENTS

| | | | |
|---|---|---|---|
| 44-20407 | 9/1969 | Japan | 340/214 |

*Primary Examiner*—Glen R. Swann, III

*Attorney, Agent, or Firm*—Wolf, Greenfield & Sacks

[57] ABSTRACT

The operability of one or more audio speakers is monitored by continuously transmitting a non-audio signal on the lines connecting to the speakers and providing a vibration sensitive transducer such as a piezoelectric transducer which continuously picks up the signal. The output from the transducer couples to detection circuitry which may comprise an amplifier and gate or trigger circuit. The output of the detection circuitry couples either via the existing speaker lines or via a separate supervision line to an alarm device. When the speaker or speaker lines are inoperative the non-audio signal is not present and the gate circuit transmits an alarm signal to an alarm device. In one embodiment the detection circuitry is supplied power directly from the speaker lines via a rectifier means. In another embodiment the detection circuitry includes an oscillator, one associated with each speaker and each constructed to oscillate at a different frequency. With this arrangement the supervisory line may connect to a decoder for sensing the oscillator frequency when a fault occurs to thereby identify the malfunctioning speaker.

15 Claims, 4 Drawing Figures

SUPERVISION OF TRANSDUCERS

BACKGROUND OF THE INVENTION

The present invention relates in general to the supervision of the operability of transducers. More particularly, as disclosed herein, this invention pertains to the supervision of audio speakers which may be used in a loud speaker system.

There is a problem associated with audio systems and especially audio systems that are used for emergency communications. There is some difficulty in insuring that the speaker is properly connected to the audio line and in operable condition. There presently exist some techniques for supervising the operability of speakers. For example, one arrangement uses a special speaker structure which comprises a separate pick-up coil. A low (subaudible) frequency is continuously impressed on the audio lines. With this prior art arrangement the cone vibrates and the movement of the magnet within the voice coil causes an induced voltage to be generated in the secondary pick-up coil. The signal from this coil is a low level signal which may be suitably amplified and used to energize a relay or operate a gate. There are some disadvantages associated with this known system. For example, special speaker assemblies are required and existing speaker systems will require replacement of the entire speaker assembly. Also, there is a noise problem in that noise can be easily picked up by the secondary pick-up coil thereby interferring with the proper monitoring of the operability of the speaker.

Accordingly, one object of the present invention is to provide an improved technique for the supervision of transducers preferably of the vibrating type such as a loud speaker.

Another object of the present invention is to provide a supervision scheme which does not require the complete replacement of the speaker. In accordance with this invention a transducer such as a piezoelectric transducer is easily secured to the speaker for detecting sub-audio signals or low amplitude signals impressed on the audio lines.

A further object of the present invention is to provide a supervision scheme that is not susceptible to noise problems associated with prior art schemes.

SUMMARY OF THE INVENTION

To accomplish the foregoing and other objects of this invention, there is provided a system for monitoring the operation of a vibrating body which in the disclosed embodiment is a speaker which typically has connected thereto an audio input line. The system comprises means coupled to the audio signal line for impressing a signal on the line which is either of a sub-audio frequency, a frequency of sub-audio level, or an ultrasonic frequency. This signal is continuously transmitted on the audio line for purposes of supervision of one or more of these speakers. A transducer is associated with the speaker and is responsive to receipt of the impressed signal. This transducer is preferably a piezoelectric transducer which is placed against the back of the speaker comb.

Detection means is coupled from the transducer means and is responsive to the absence of receipt of the impressed signal on the audio line for generating an alarm condition indicative of the inoperability of the speaker. With one arrangment the detection means is powered by a separate power source while in an alternate embodiment the detection means has its power supply directly from the speaker lines via a rectifier means. The connection to the alarm device can be made eiher via the existing audio input lines or via a separate supervisory line. In one version in accordance with the present invention, it is desirable to detect which one of a plurality of speakers may be inoperative. In this system a plurality of oscillators are employed as part of the detection circuitry one being associated with each speaker. Each oscillator is designed to oscillate at a different frequency and a decoder is provided for sensing the oscillator frequency when a fault occurs to thereby identify the malfunctioning speaker.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figures 1, 2:
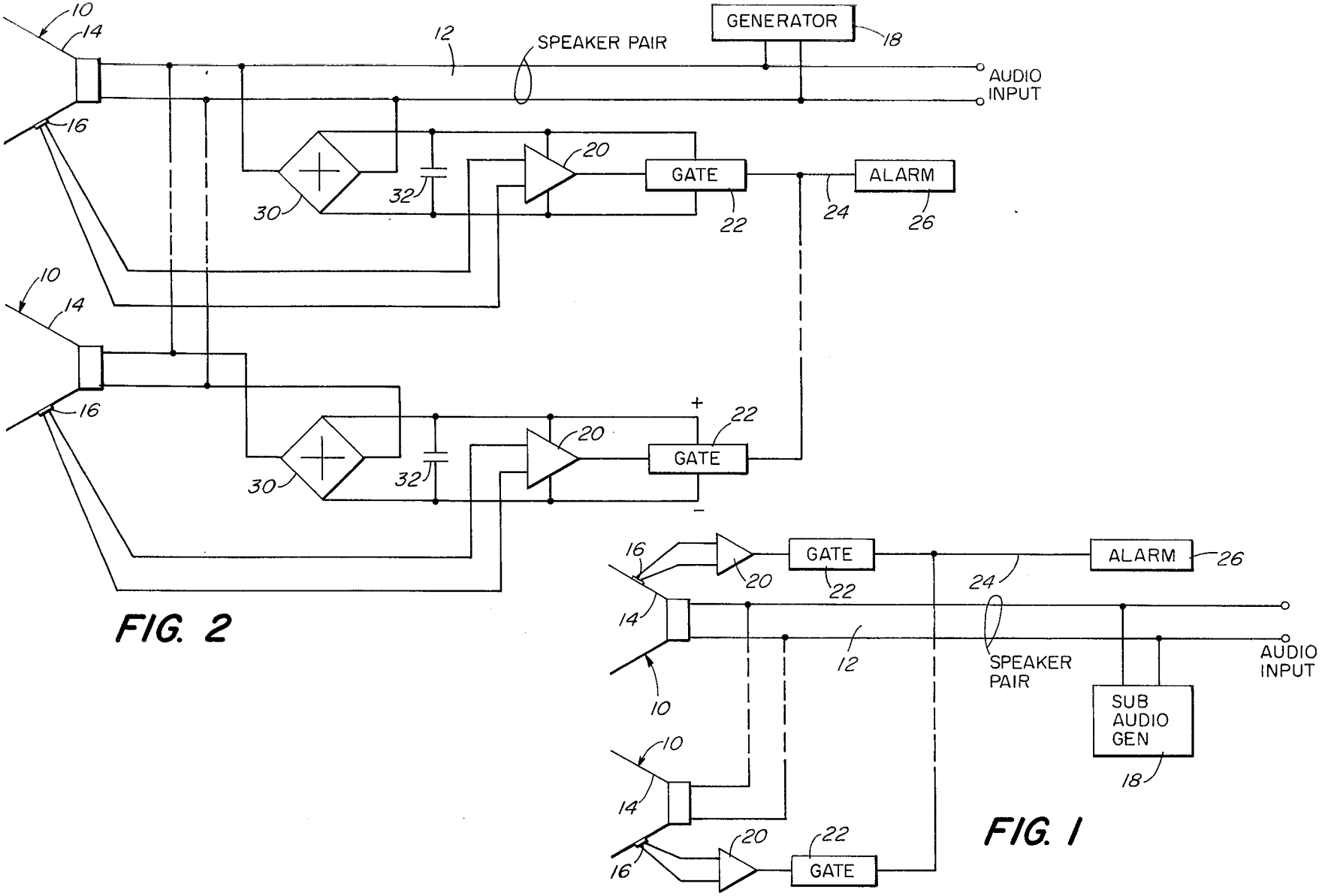
FIG. 1 is a schematic block diagram of a basic system of the present system employing a separate supervisory line to the alarm device.
FIG. 2 shows a schematic block diagram of another system of the present invention wherein the detection circuitry is self-powered from the audio lines.

FIG. 1 is a schematic block diagram showing speakers 10 which receive a common input from audio line 12. This audio line may couple to a large number of the speakers in an actual installation. The speakers may be of conventional design and even of relatively simple construction. Each speaker 10 comprises a cone 14 which has mounted thereto a transducer 16 which preferably is a piezoelectric transducer that develops an electric polarity thereacross in response to vibrations of the cone.

In accordance with this invention a frequency is continuously transmitted on the audio line 12. This frequency may be either a sub-audio frequency, a frequency of sub-audio level, or an ultrasonic frequency. FIG. 1 shows a sub-audio generator 18 coupled to the audio input line 12 for continuously impressing a signal on this line which is continuously monitored by the transducer 16.

Each of the transducers 16 couples respectively to an amplifier 20 which receives it power from an external source (not shown). The amplifier 20 amplifies the AC signal from the transducers 16. The output of amplifier 20 couples by way of gate circuit 22 to the supervisory line 24. Line 24 couples to alarm 26 which may be disposed at a location remote from the speakers. The amplifier 20 and the gate 22 may both be of conventional design. The amplifier 20 may be a simple transistor amplifier.The gate 22 may, for example, comprise a half-wave rectifier which establishes a predetermined voltage level on line 24 maintaining the alarm 26 inactive until a malfunction occurs. The output from the transducer 16 is of a fairly high level and is easily amplified by amplifer 20. Should the speaker become loaded, ie blocked by an object which drastically limits the excursion of the cone/coil, the amplitude transmitted to the transducer is drastically reduced. This in turn reduces the level on line 24 and a supervisory alarm is initiated at alarm device 26. The gate circuit 22 may also simply be a threshhold detector or comparator having one of two different outputs depending upon the level of the signal from amplifier 20.

In accordance with the system of the present invention it is noted that this system is quite easily adapted to an existing speaker system. There is not modification required of the speaker itself. It is possible to place the transducer on any convenient part of this speaker. Actually, the transducer can be placed on any suitable part of the enclosure for the speaker such as the speaker baffle. This will also pick up vibrations initiated by the speaker. In another embodiment a microphone can be suitably supported adjacent the speaker or in contact with the speaker to pick up the acoustic energy from the speaker.

In FIG. 1 the generator 18 may also be of conventional design. The device 18 may be a conventional oscillator. The alarm 26 is also of conventional design and includes an alarm relay which is normally maintained energized by the signal on line 24 until an alarm condition occurs at which time the relay is de-energized to signal the alarm.

Figure 3:
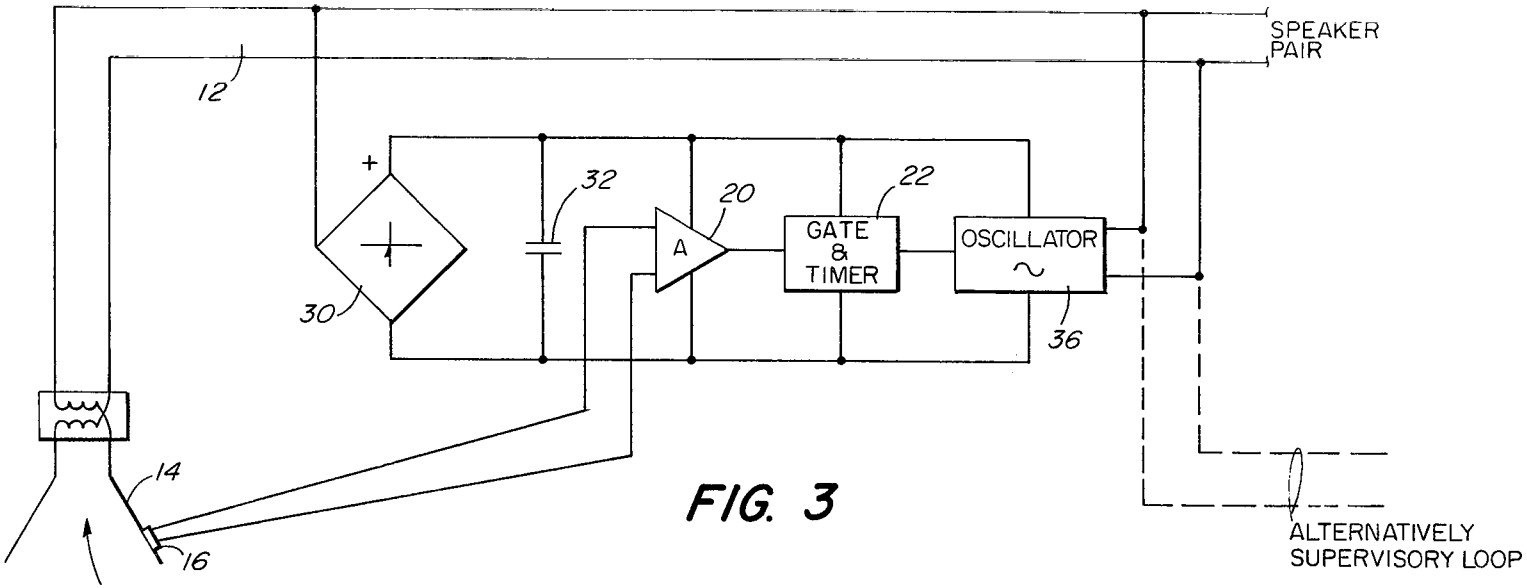
FIG. 3 shows a schematic block diagram similar to that shown in FIG. 2 with sightly different detection circuitry and with the connection therefrom being made to the alarm device by way of the audio speaker lines.
Figure 4:
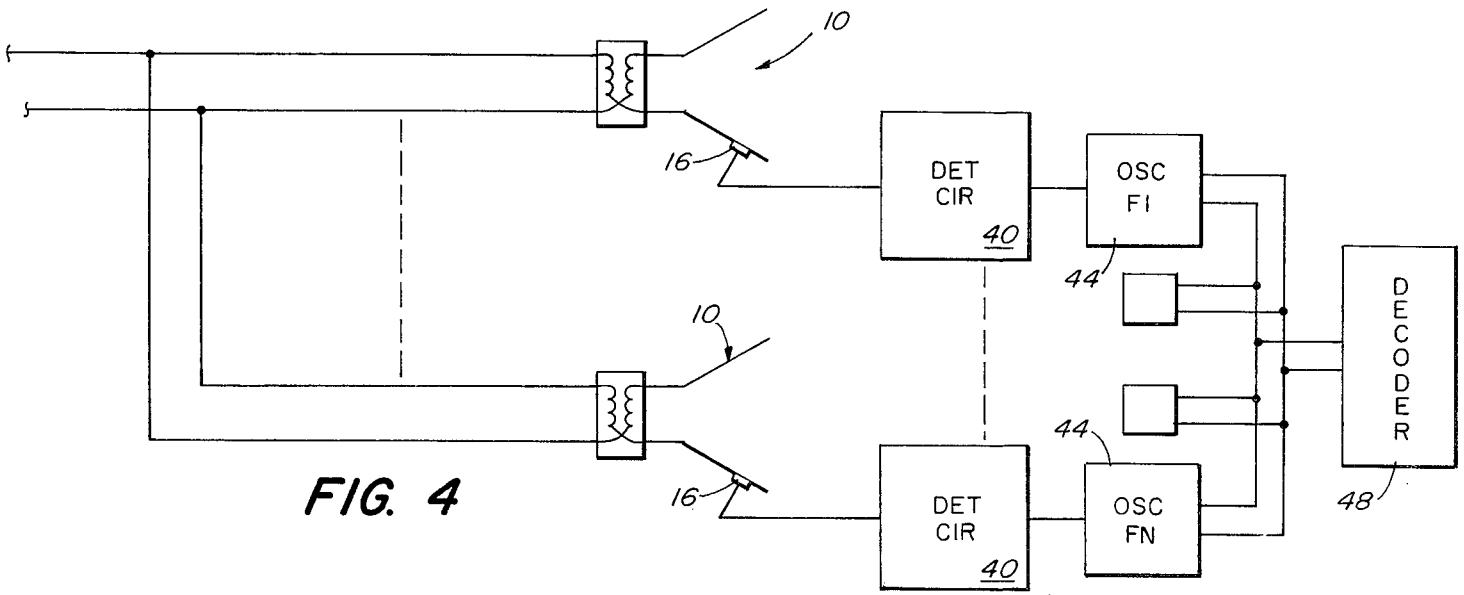
FIG. 4 is a schematic block diagram for another version of the invention employing a detection scheme for identifying the inoperative speaker.

In FIGS. 2–4, similar reference characters to those employed in FIG. 1 will be used to identify similar parts of the system. Thus, in FIG. 2 there is shown speaker 10, amplifier 20, gate 22, generator 18, and alarm 26. The arrangement shown in FIG. 2 is substantially identical to that shown in FIG. 1 except that the amplifier 20 and gate 22 is not powered from a separate source but instead receives its power from the input audio line 12. Each of the speakers has associated therewih a rectifier 30 which may be a conventional full-wave rectifier bridge. The input to the rectifier 30 couples from line 12 and the output from the rectifier couples by way of capacitor 32 to both the amplifier 20 and the gate 22. The voltage across the capacitor 32 is an unregulated voltage that is used to power both the amplifier and gate. A regulator may also be associated with the rectifier and capacitor for providing a regulated voltage for the amplifier and gate.

FIGS. 1 and 2 show the output from the gates 22 coupling by way of a supervisory line 24 to the alarm 26. In an alternate arrangement of either of these systems, the output from the gates 22 may couple back to the audio input line and the audio input line may be used as the line for supervising the presence of the audio signals. In this case, both the generator 18 and the alarm 26 are connected to the audio input line but the alarm 26 is activated not in response to the audio signal from generator 18 but from the detection of a level change, for example, of a DC value from either of the gates 22.

Referring now to FIG. 3, for the sake of simplicity, only one speaker is shown. However, it is understood that other speakers could connect to the audio input line 12. The detection circuitry shown in FIG. 3 is substantially identical to that shown in FIG. 2 except that there is also included an oscillator 36 which is coupled from the output of the gate 22. The amplifier 20, gate 22, and oscillator 36 are all powered from the rectifier 30 and associated capacitor 32 as in the embodiment of FIG. 2. It is noted in FIG. 3 that the output from the oscillator 36 couples directly to the audio input line 12. The gate 22 may also comprise a timer or delay circuit. In the normal operating state when the speaker is operating properly, the output of the gate circuit 22 maintains the oscillator 36 disabled. If there is a speaker failure there will be no output from the amplifier and the gate 22 causes the oscillator 36 to send out a tone burst on the speaker line. As previously mentioned the gate 22 may comprise a timer. This timer is operated from the output of the amplifier 20 at a pedetermined level as long as an AC signal is received from the amplifier. When this AC signal terminates then the timer output reverts to a different level. The first level from the timer inhibits operation of the oscillator and the second level which occurs under a fall condition permits the oscillator 36 to operate and the oscillator generates a tone burst on the line 12 which is coupled to an alarm device which is not shown in FIG. 3.

One of the problems associated with the arrangement of FIG. 3, however, is that the method is not suitable where the speaker line has to be supervised as failure of this line will not allow the tone burst to be transmitted to a central control area where the alarm device is disposed. Thus, in an alternate embodiment the output of the oscillator 36 may be coupled over a separate supervisory loop where advantage can also be taken of tone bursts of different frequencies which can be then decoded to remotely identify which speaker has malfunctioned or is in a troubled condition.

The embodiment of FIG. 4 shows this type of an arrangement. In FIG. 4 there are shown speakers 10 each having associated therewith a transducer 16 the output of which couples to a detection circuit which may be of the type shown in FIG. 1 or FIGS. 2 and 3. In FIG. 4 this detection circuit is identified by the reference character 40. The detection circuit may comprise an amplifier and a timer. The output from each detection circuit couples to an oscillator 44 and the output from the oscillators couple either in common or separately to a decoder circuit 48.

Under normal operating conditions when all of the speakers are functioning properly, the detection circuits 40 each maintain their associated oscillator 44 in a disabled condition. Thus, the output from all of the oscillators to the decoder 48 are all just DC levels which the decoder 48 in essence ignors. When one of the speakers becomes inoperative then the output of the associated detection circuit 40 permits operation of its associated oscillator 44. The decoder 48 then receives an oscillatory signal or tone burst. Each of the oscillators 44 is set to oscillate at a different frequency and the decoder 48 is adapted to decode which of the frequencies is received. In this manner one can detect which one of the speakers has malfunctioned. The decoder 48 may be of conventional design and may include a mono-stable multi-vibrator that sets a predetermined pulse width, and an integrator. With this arrangement the decoder 48 has an output level that is representative of a predetermined input frequency from one of the oscillators 44. The decoder 48 may also comprise a level detector for providing individual discrete outputs corresponding to each of the oscillators. These outputs could activate individual alarm devices or other signaling devices such as an array of lamps for specifically identifying the malfunctioning or inoperative speaker.

Having described a limited number of embodiments of the present invention, it should now become obvious to one skilled in the art that numerous other embodiments and modifications of the ones shown herein are contemplated as falling within the scope of the present invention. The disclosure herein has been limited for illustration purposes to a system used in conjunction with a loud speaker. However, it is understood that the system may also be used in conjunction with other types of vibrating transducers.

What is claimed is:

1. A system for monitoring the operation of at least one loud speaker means which has connected thereto an input signal line upon which audio signals are impressed for transmission to the speaker means, said system comprising;

means for coupling an alternating supervisory signal on the input signal line, vibration sensitive transducer means directly responsive to mechanical deflections of the cone of the speaker and means for mounting the transducer means to the cone of the speaker means whereby the transducer means is responsive to the vibrations of the speaker means for providing an electrical alternating signal corresponding to the frequency of vibration of the speaker means, and detection means coupled from the transducer means and responsive to the absence of the electrical alternating signal for generating an alarm condition indicative of the inoperability of the speaker means or input signal line.

2. A system as set forth in claim 1 wherein the transducer means includes a piezoelectric transducer.

3. A system as set forth in claim 1 including a plurality of speakers and like plurality of detection means.

4. A system as set forth in claim 3 wherein each said detection means comprises an amplifier means and gate means and further comprising a common alarm device to which all the gate means couples.

5. A system as set forth in claim 4 including a supervisory line coupled between detection means and alarm device so that the alarm device is disposed remote from the speakers.

6. A system as set forth in claim 1 including means coupled from the audio input line for providing operating power to the detection means.

7. A system as set forth in claim 6 wherein said means for providing operating power comprises an AC-to-DC converter means.

8. A system as set forth in claim 7 wherein said AC-to-DC converter means includes a rectifier means.

9. A system as set forth in claim 1 wherein the detection means includes a detection circuit, an alarm device and means coupling the detection circuit to the alarm device.

10. A system as set forth in claim 9 wherein the means coupling comprises a separate supervisory line independent of the audio input line.

11. A system as set forth in claim 9 wherein the means coupling comprises the audio input line.

12. A system as set forth in claim 3 including a common alarm means.

13. A system as set forth in claim 12 wherein said detection means includes an oscillator which is disabled when the speakers are operative and transmits a tone signal to the alarm means when one of the speakers malfunctions.

14. A system as set forth in claim 13 wherein an oscillator is associated with each speaker and each oscillator has a different operating frequency.

15. A system as set forth in claim 14 including means coupled from the oscillators for detection of the frequency of any oscillator that operates in response to a malfunctioning speaker.

* * * * *